US009015873B2

(12) United States Patent
McKain et al.

(10) Patent No.: US 9,015,873 B2
(45) Date of Patent: Apr. 28, 2015

(54) DRAIN SUMP

(76) Inventors: Paul C. McKain, Tallahassee, FL (US); Pierce C. McKain, Tallahassee, FL (US)

( * ) Notice: Subject to any disclaimer, the term of this patent is extended or adjusted under 35 U.S.C. 154(b) by 862 days.

(21) Appl. No.: 13/212,351

(22) Filed: Aug. 18, 2011

(65) Prior Publication Data

US 2012/0272444 A1 Nov. 1, 2012

Related U.S. Application Data

(60) Provisional application No. 61/481,213, filed on May 1, 2011.

(51) Int. Cl.
*E04H 4/00* (2006.01)
*E04H 4/12* (2006.01)

(52) U.S. Cl.
CPC ..... *E04H 4/1236* (2013.01); *E04H 4/1245* (2013.01)

(58) Field of Classification Search
CPC ..... E04H 4/1236; E04H 4/1218
USPC ..... 4/507, 508, 686, 687, 653, 288, 490
See application file for complete search history.

(56) References Cited

U.S. PATENT DOCUMENTS

| | | | | |
|---|---|---|---|---|
| 2,374,642 | A * | 5/1945 | Bloch | 4/687 |
| 4,092,803 | A * | 6/1978 | Naylor | 4/687 |
| 6,393,628 | B1 * | 5/2002 | Kellogg | 4/507 |
| 7,284,565 | B2 * | 10/2007 | Sebor | 137/114 |

FOREIGN PATENT DOCUMENTS

| | | | | |
|---|---|---|---|---|
| DE | 4212205 | A1 * | 10/1993 | E04H 4/1236 |

* cited by examiner

*Primary Examiner* — Tuan N Nguyen
(74) *Attorney, Agent, or Firm* — Robert M. Downey, P.A.

(57) ABSTRACT

A drain sump includes a secondary chamber for providing an alternate source of water for the main drain to pull water from, thereby limiting the suction force created when the flow of water is obstructed. In a preferred embodiment, the two chambers within the drain sump are partitioned by a septum wall, which provides a passage for a drain pipe extension at the center of the septum wall and further includes a plurality of venting channels for ideal water flow between the two chambers. Each chamber is in open fluid flow communication with the pool water via the drain grate. Relief hole passages are included on the drain pipe extension for providing open fluid communication between the secondary chamber and the water flow passage. The drain pipe extension may further include two 90 degree bends for restricting access to the water flow passage of the drain pipe extension.

4 Claims, 3 Drawing Sheets

DRAIN SUMP

This application claims the benefit of U.S. Provisional Patent Application Ser. No. 61/481,213 filed on May 1, 2011.

BACKGROUND OF THE INVENTION

1. Field of the Invention

The present invention relates to drain sumps and, more particularly, to a drain sump that is structured for limiting the vacuum force that is produced when an individual or object obstructs the flow of water entering the opening of a drain pipe in communication with a pool pump.

2. Discussion of the Related Art

Generally, one or two main drains are included on a swimming pool's floor or side wall as part of the swimming pool circulation system, which drains and filters pool water prior to directing the water back into the swimming pool. A drain sump at the swimming pool floor is in communication with the main drain and includes a drain grate for blocking access to the drain sump. The primary force in draining the pool water is the suction produced by the pool pump, which pulls water from the swimming pool into the main drain(s). The considerably high amount of suction produced by the pool pump has resulted in a number of accidents involving individuals swimming in the vicinity of the drain sump being trapped against the drain grate, creating a vacuum within the main drain between the obstruction and the pool pump, which can result in serious injury and/or death by drowning. In cases where the drain grate is damaged or missing, the visible opening creates an attractive nuisance to children who are likely to inspect the exposed drain sump and possibly get their arm or leg caught in the drain pipe, making it extremely difficult to pry the child to safety.

In order to combat this issue, a number of attempts have been directed towards improving the design of the main drain and drain sump. One example of such an attempt is provided in U.S. Pat. No. 7,455,070 to Hamza, which discloses a vacuum relief safety valve attached to a pool pump and having an air inlet aperture exposed to ambient air and a sealing element which is pressed against the aperture by a spring. In the event that the maximum allowed vacuum level in the pump is exceeded, the sealing element moves into the inner chamber and opens the air inlet aperture, causing the pump to lose its prime. The '070 patent, while useful for its intended purpose, does not provide adequate assurance of an entrapped swimmer's escape due to the requirement that the obstructing object or swimmer must actually create a vacuum force in to trigger the maximum vacuum level and open the air inlet valve. The '070 patent and others fail to provide a simple and effective design for preventing entrapment of a swimmer within a drain sump.

Therefore, there remains a need for a drain sump that limits the vacuum force produced by suction in the event that a person obstructs the flow of water through the drain sump, thereby allowing the person to safely escape entrapment.

3. Objects and Advantages of the Invention

Considering the foregoing, it is a primary object of the present invention to provide a drain sump that prevents injuries from occurring when an individual obstructs the flow of water into the opening of a drain pipe in communication with a pool pump.

It is a further object of the present invention to provide a drain sump for limiting the vacuum force that is otherwise produced when an individual obstructs the flow of water into the opening of a drain pipe in communication with a pool pump.

It is a further object of the present invention to provide a drain sump that includes secondary openings for a main drain in communication with a pool pump to pull water from.

It is a further object of the present invention to provide a drain sump that can be easily manufactured.

It is still a further object of the present invention to provide a drain sump that lessens the impact of the increased suction that occurs when a user installs a pump having greater horsepower than the pool system is designed to utilize.

These and other objects and advantages of the present invention are readily apparent with reference to the detailed description and accompanying drawings.

SUMMARY OF THE INVENTION

The present invention is directed to a drain sump having a secondary safety chamber for providing an alternate source of water for the main drain to draw water from, thereby limiting the suction force created when the drain pipe is obstructed. In a preferred embodiment, the two chambers within the drain sump are partitioned by a septum wall, which includes a passage for a drain pipe extension in communication with the main drain at the center of the septum wall and further includes a plurality of venting channels for allowing ideal water flow between the two chambers. Each of the chambers has open fluid flow communication with the pool water via the drain grate. A plurality of relief hole passages are included on the drain pipe extension for providing open fluid communication between the secondary chamber and the water flow passage. The drain pipe extension further includes two 90 degree bends for restricting access to and within the water flow passage of the drain pipe.

BRIEF DESCRIPTION OF THE DRAWINGS

For a fuller understanding of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
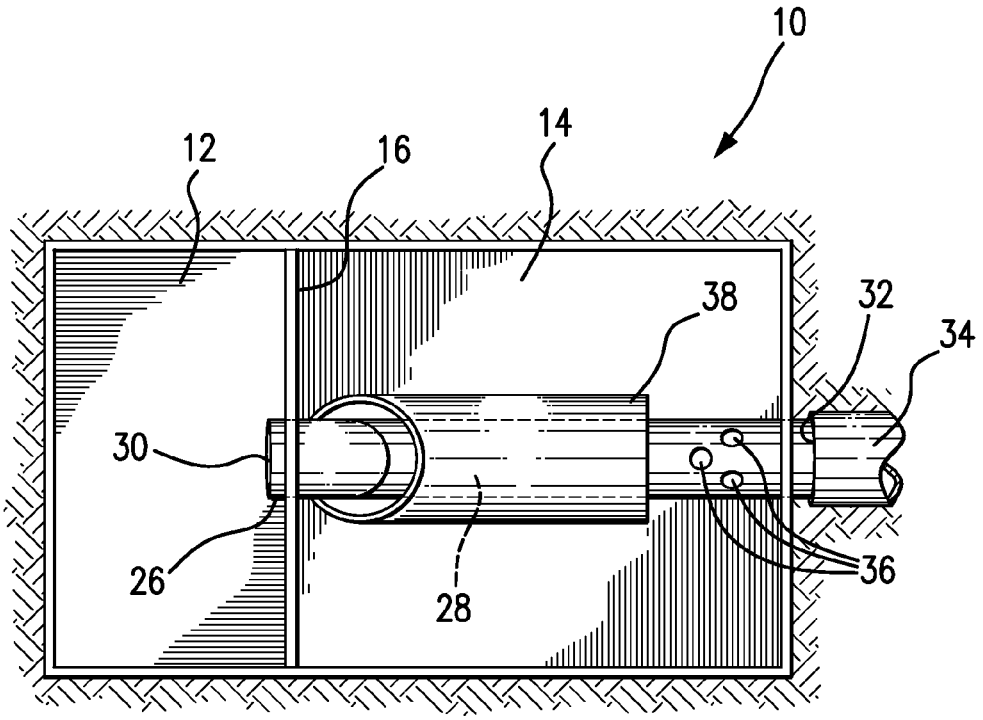
FIG. 1 is a top plan view, in partial cross-section, illustrating the drain sump of the present invention.

Referring to the several views of the drawings, a drain sump is shown in accordance with several preferred embodiments and provided for installation within a swimming pool or spa. In each of the drawing figures, the drain sump is generally indicated as 10.

Figure 2:
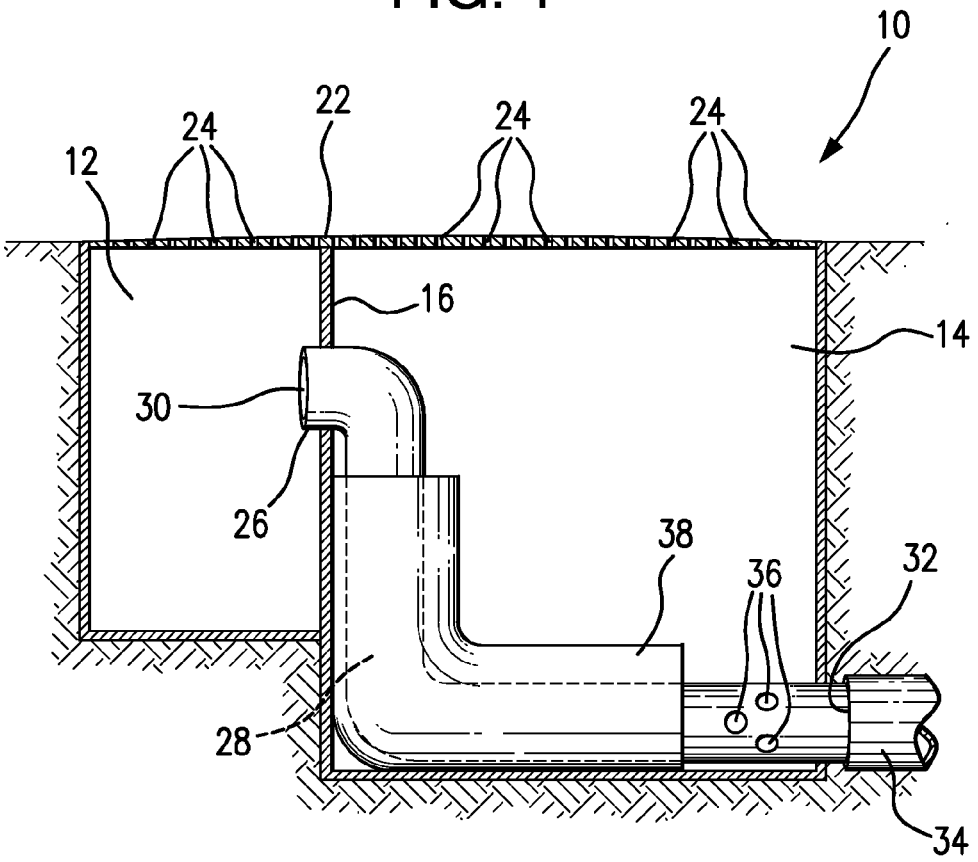
FIG. 2 is an isolated side plane view, in partial cross-section, illustrating the drain sump of the present invention.
Figure 3:
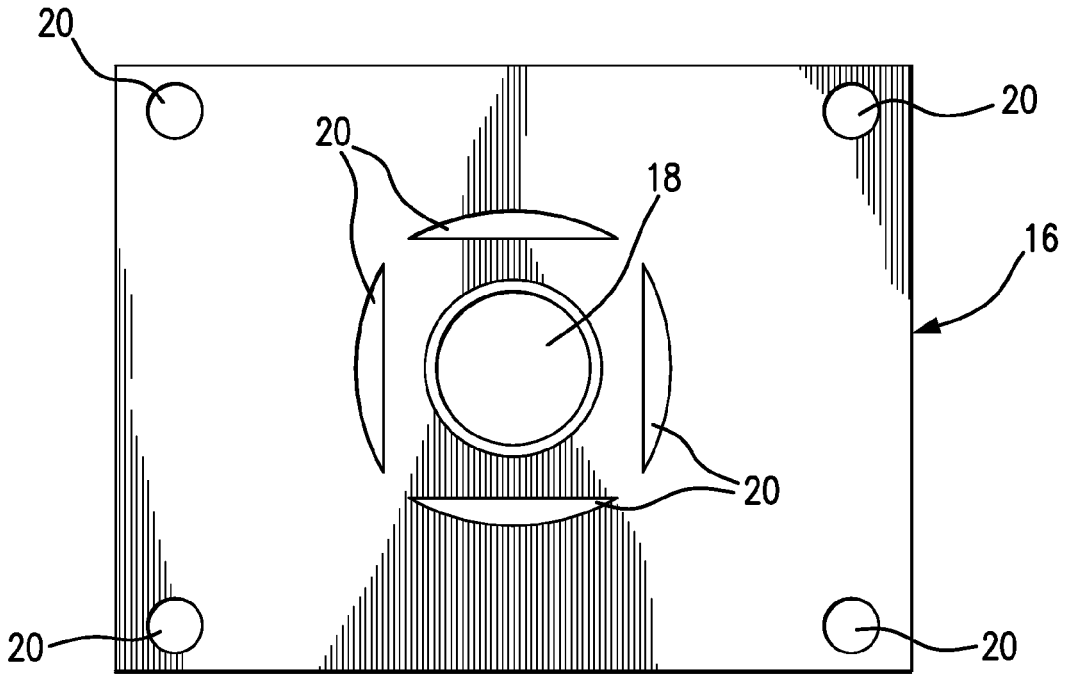
FIG. 3 is an isolated view illustrating the septum wall separating the first and second chambers of the drain sump of the present invention.

Referring initially to FIGS. 1-3, the drain sump 10 includes a first chamber 12 and a second chamber 14 that are separated by a septum wall 16. The septum wall 16 includes a drain pipe passage 18 which extends throughout the width of the septum wall 16 and provides open communication between the first and second chambers 12 and 14. Surrounding the drain pipe passage 18 is a plurality of venting channels 20, as particularly illustrated in FIG. 3, which serve to provide ideal water flow between each of the chambers 12 and 14.

A drain grate 22 is sized and configured for secured attachment above the first and second chambers 12 and 14 for preventing objects from entering the drain sump 10. Included on the drain grate 22 is plurality of openings 24 for allowing fluid flow communication between the swimming pool and the first and second chambers 12 and 14.

A drain pipe extension 26 having a water flow passage 28 extending between its front opening 30 and rear opening 32 is sized and configured for watertight engagement within the drain pipe passage 18. As seen in FIGS. 1 and 2, the front opening 30 of the drain pipe extension 26 is in open fluid flow communication with the first chamber 12 and the rear opening 32 is in sealed fluid flow communication with the main drain 34. Further included on the drain pipe extension 26 is a plurality of relief hole passages 36, which provide open fluid flow communication between the second chamber 14 and the water flow passage 28. A pipe protection member 38 extends from the septum wall 16, surrounding the drain pipe extension 26 up to the location of the relief hole passages 36, and serves to prevent entanglement of a foreign object with the drain pipe extension 26.

In operation, a pool pump in communication with the main drain 34 creates a suction force at the front opening 30 of the drain pipe extension 26 and the plurality of relief hole passages 36, pulling water through the drain grate 22 and into the first and second chambers 12 and 14 of the drain sump 10. Water flows through the water flow passage 28 at the front opening 20 and relief hole passages 36, traveling the length of the drain pipe extension 26 before entering the main drain 34. The plurality of venting channels 20 provides a secondary source for pulling water from the first chamber 12, as the suction force at the plurality of relief hole passages 36 pulls water through the venting channels 20 and into the second chamber 14 and, subsequently, the relief hole passages 36.

In the event that the flow of water entering the front opening 30 of the drain pipe extension 26 is obstructed by an object, e.g. a child's arm or leg, the drain sump 10 allows the main drain 34 to continue pulling water through the relief hole passages 36, thereby avoiding the creation of a vacuum force. Therefore, if an individual is able to gain access to the front opening 30 of drain pipe extension 26 and inserts his or her hand into the water flow passage 28, he or she will not be entrapped by the force of the main drain 34, as the main drain 34 remains able to pull water through the relief hole passages 36.

As illustrated in the drawing figures, a preferred embodiment of the drain pipe extension 26 features two 90 degree bends for providing an additional impediment against obstructing the flow of water within the water flow passage 28 of the drain pipe extension 26.

Figure 4:
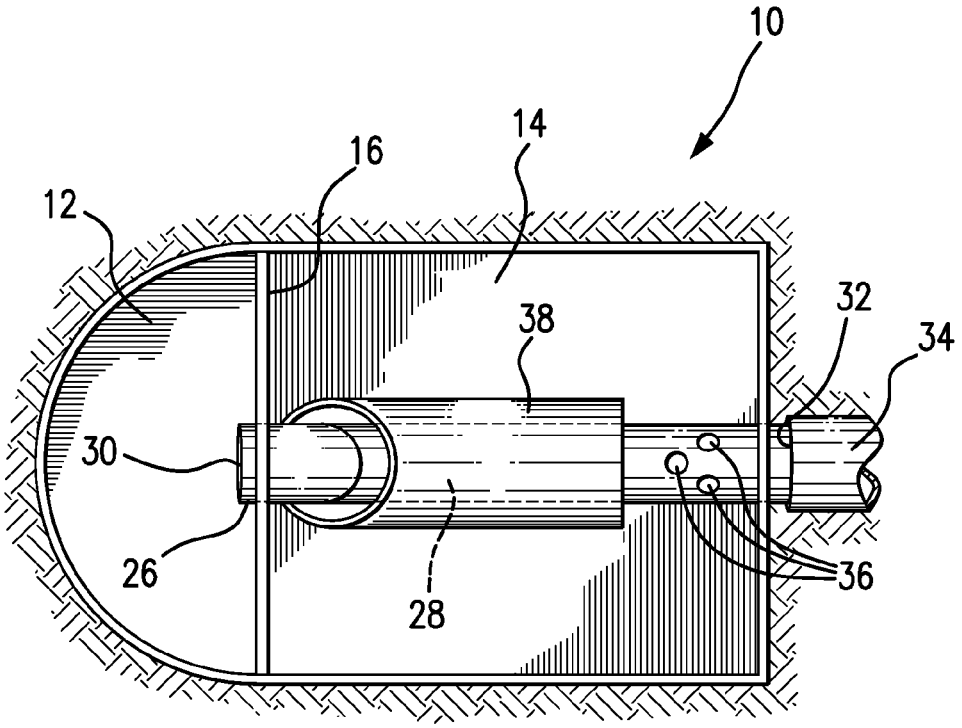
FIG. 4 is a top plan view, in partial cross-section, illustrating an alternate embodiment of the drain sump of the present invention wherein a more compact version of the first chamber is provided.

Referring to FIG. 4, an alternate embodiment of the drain sump 10 is provided that is sized and configured for use in conjunction with a smaller swimming pool or spa, wherein the first and second chambers 12 and 14 are sized smaller. Preferably, the first chamber 12 includes a semi-annular wall, as depicted, for limiting the surface area required for installation.

Figure 5:
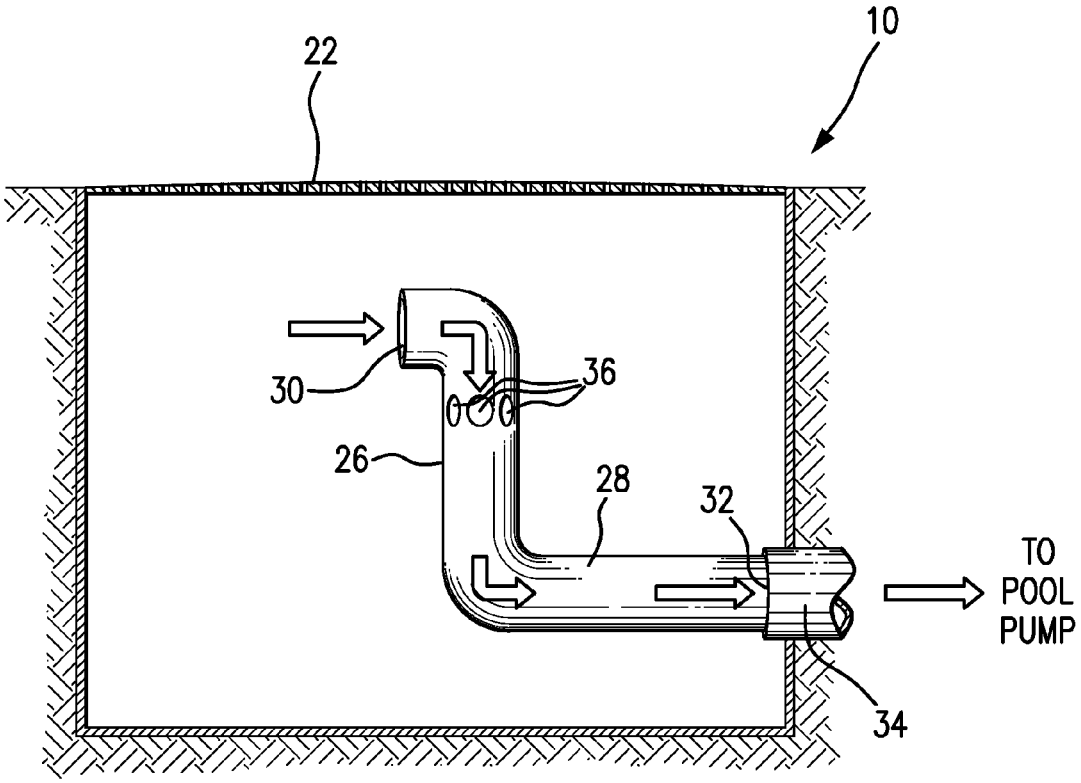
FIG. 5 is an isolated side plane view, in partial cross-section, illustrating a second alternate embodiment of the drain sump of the present invention wherein relief holes are located on a drain pipe extension, which is sized and configured for connecting to the main drain.

Another alternate embodiment is shown in FIG. 5, wherein a modified drain pipe extension 26 is sized and configured for use within a pre-installed drain sump typically found in swimming pools and spas. The modified drain pipe extension 26 includes relief hole passages 36 that are located along the vertical portion in between the two 90 degree bends of the modified drain pipe extension 26. While the modified drain pipe extension 26 illustrated in FIG. 5 includes relief hole passages 36 located on the vertical portion of the drain pipe extension 26, the relief hole passages 36 may be located at any suitable location along the drain pipe extension 26. In operation, when an object obstructs the flow of water from entering the front opening 30 of the modified drain pipe extension 26, a vacuum force will not be produced between the obstruction and the pool pump, as the main drain remains able to pull water through the relief hole passages 36.

Figure 6:
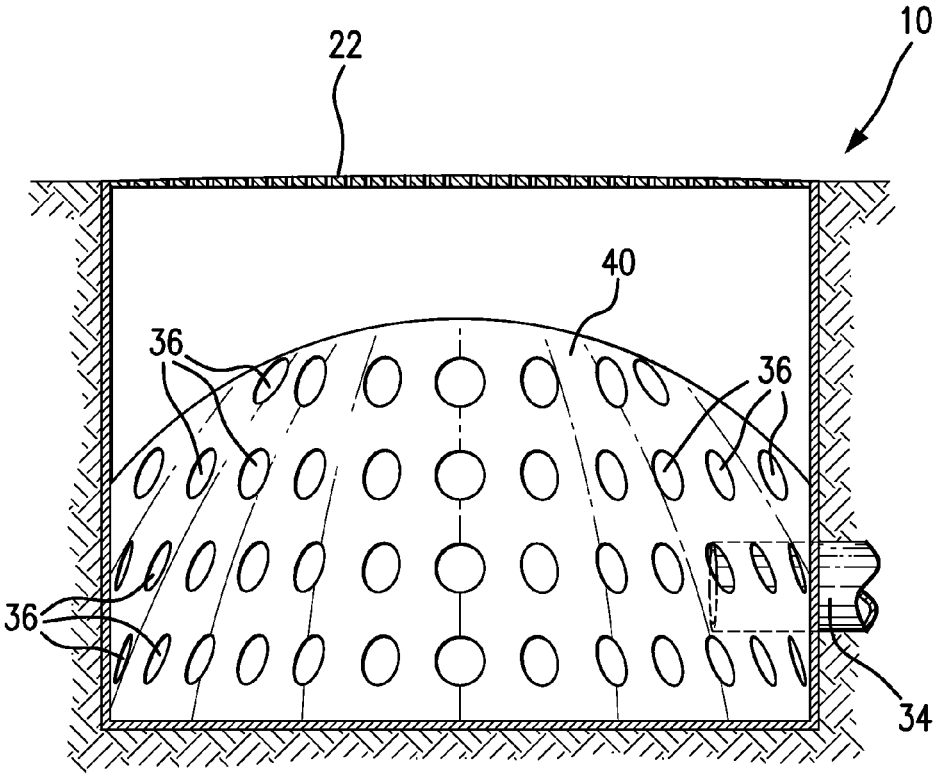
FIG. 6 is a side plane view, in partial cross-section, illustrating a third alternate embodiment of the drain sump of the present invention wherein a vented dome having relief holes has been installed within the drain sump.

Referring to FIG. 6, another alternate embodiment of the drain sump 10 is provided, wherein a vented dome 40 encases the front opening 30 of the drain pipe extension 26 within the drain sump 10. The vented dome 40 includes a plurality of relief hole passages 36. The shape of the vented dome 40 decreases the chances of an object from completely obstructing the flow of water between the water source and the pool pump, as each of the relief hole passages 36 is located at a different planar level about the surface of the dome 40. Therefore, in the event of an obstruction to one of the relief hole passages 36, the main drain will remain able to pull water through an unobstructed relief hole passage 36.

A common issue in the swimming pool industry is the mistaken belief that use of a high volume pump having greater horsepower than the corresponding pool was designed to sustain will result improved performance. Use of pool pumps having excessive horsepower can increase the risk of a swimmer being entrapped against a drain grate. The drain sump 10 of the present invention limits the negative impact of installing a pump having excessive horse power, as a portion of the excessive suction force drawing water into the first chamber 12 will be diverted to some extent through the relief hole passages 36, which limits the total amount of suction force pulling water through the drain grate 22.

While the present invention has been shown and described in accordance with several preferred and practical embodiments thereof, it is recognized that departures from the instant disclosure are fully contemplated within the spirit and scope of the invention as defined in the following claims and as interpreted under the Doctrine of Equivalence.

What is claimed is:

1. A drain sump for use with a swimming pool or spa having a main drain pipe, said drain sump comprising:

a chamber in open fluid flow communication with said swimming pool or spa;

a unitary, one-piece drain pipe extension including a water flow passage extending between a normally unobstructed front opening and a rear opening for directional flow of water therethrough, said front opening positionable in open and unobstructed fluid flow communication with said chamber and said rear opening being adapted for sealed attachment to the main drain pipe in fluid flow communication therewith;

said unitary, one-piece drain pipe extension including a plurality of open and unobstructed relief hole passages for open and unobstructed fluid communication between said chamber and said water flow passage; and whereby suction from a pool pump in communication with said main drain pipe causes water to enter said water flow passage at said front opening of said drain pipe extension and said plurality of open and unobstructed relief hole passages and exit at said rear opening into the main drain pipe, and whereby water is allowed to enter said water flow passage through said plurality of open and unobstructed relief hole passages in the event of an external obstruction at said normally unobstructed front opening and thereby preventing a vacuum at said front opening and within said drain pipe extension.

2. The drain sump as recited in claim 1 wherein said drain sump further includes a drain grate sized and configured for attachment above said chamber, and said drain grate including a plurality of openings for allowing fluid flow communication between said swimming pool or spa and said chamber.

3. The drain sump as recited in claim 1 wherein said unitary, one-piece drain pipe extension includes a first 90 degree bend and a second 90 degree bend, said first and second 90 degree bends being sized and configured for discouraging insertion of an object within said water flow passage.

4. A drain sump for use with a swimming pool or spa having a main drain pipe, said drain sump comprising:

a chamber in open fluid flow communication with said swimming pool or spa;

a unitary, one-piece drain pipe extension including a water flow passage extending between a normally unobstructed front opening and a rear opening for directional flow of water therethrough, said front opening positionable in open and unobstructed fluid flow communication with said chamber and said rear opening being adapted for sealed attachment to the main drain pipe in fluid flow communication therewith;

said unitary, one-piece drain pipe extension including a plurality of open and unobstructed relief hole passages for open and unobstructed fluid communication between said chamber and said water flow passage;

said unitary, one-piece drain pipe extension includes a first 90 degree bend and a second 90 degree bend, said first and second 90 degree bends being sized and configured for discouraging insertion of an object within said water flow passage; and whereby suction from a pool pump in communication with said main drain pipe causes water to enter said water flow passage at said front opening of said drain pipe extension and said plurality of open and unobstructed relief hole passages and exit at said rear opening into the main drain pipe, and whereby water is allowed to enter said water flow passage through said plurality of open and unobstructed relief hole passages in the event of an external obstruction at said normally unobstructed front opening and thereby preventing a vacuum at said front opening and within said drain pipe extension.

* * * * *